US011680568B2

(12) United States Patent
Nohales Herraiz et al.

(10) Patent No.: US 11,680,568 B2
(45) Date of Patent: Jun. 20, 2023

(54) COMPRESSOR OIL MANAGEMENT SYSTEM

(71) Applicant: EMERSON CLIMATE TECHNOLOGIES, INC., Sidney, OH (US)

(72) Inventors: Jesus Angel Nohales Herraiz, Aachen (DE); Xiaogeng Su, Mechelen (BE); Sheng Liang, Suzhou (CN)

(73) Assignee: Emerson Climate Technologies, Inc., Sidney, OH (US)

( * ) Notice: Subject to any disclaimer, the term of this patent is extended or adjusted under 35 U.S.C. 154(b) by 44 days.

(21) Appl. No.: 17/279,047

(22) PCT Filed: Sep. 28, 2018

(86) PCT No.: PCT/CN2018/108228
§ 371 (c)(1),
(2) Date: Mar. 23, 2021

(87) PCT Pub. No.: WO2020/061998
PCT Pub. Date: Apr. 2, 2020

(65) Prior Publication Data

US 2022/0042509 A1 Feb. 10, 2022

(51) Int. Cl.
*F04C 29/02* (2006.01)
*F04C 18/02* (2006.01)
*F04C 23/00* (2006.01)

(52) U.S. Cl.
CPC ..... *F04C 29/023* (2013.01); *F04C 18/0215* (2013.01); *F04C 23/008* (2013.01); (Continued)

(58) Field of Classification Search
CPC .. F04C 29/023; F04C 18/0215; F04C 23/008; F04C 29/025; F04C 2240/50; F04C 2240/603; F04C 2240/809
See application file for complete search history.

(56) References Cited

U.S. PATENT DOCUMENTS 2,777,394 A 1/1957 Modrovsky et al.
3,039,677 A 6/1962 Nissley
(Continued)

FOREIGN PATENT DOCUMENTS

CN 2081885 U 7/1991
CN 1127541 A 7/1996
(Continued)

OTHER PUBLICATIONS

English Machine Translation of CN 102734170A (Year: 2012).*
(Continued)

*Primary Examiner* — Dominick L Plakkoottam
*Assistant Examiner* — Paul W Thiede
(74) *Attorney, Agent, or Firm* — Harness, Dickey & Pierce, P.L.C.

(57) ABSTRACT

A compressor includes a compression mechanism and a driveshaft that drives the compression mechanism. The driveshaft may include a first axially extending passage, a second axially extending passage, and a lubricant distribution passage. The first and second axially extending passages may be radially offset from each other and may intersect each other at an overlap region. The first and second axially extending passages are in fluid communication with each other at the overlap region. The lubricant distribution passage may extend from the first axially extending passage through an outer diametrical surface of the driveshaft. The lubricant distribution passage may be disposed at a first axial distance from a first axial end of the driveshaft. A first axial end of the overlap region may be disposed at a second axial distance from the first axial end of the driveshaft. The first axial distance may be greater than the second axial distance.

21 Claims, 4 Drawing Sheets

(52) U.S. Cl.
CPC ..... *F04C 29/025* (2013.01); *F04C 2240/50* (2013.01); *F04C 2240/603* (2013.01); *F04C 2240/809* (2013.01)

(56) References Cited

U.S. PATENT DOCUMENTS

| | | | | |
|---|---|---|---|---|
| 3,229,901 | A | 1/1966 | Parker | |
| 3,334,808 | A | 8/1967 | Parker et al. | |
| 3,448,918 | A | 6/1969 | Cawley | |
| 3,465,954 | A | 9/1969 | Ellis | |
| 3,545,891 | A | 12/1970 | Parker | |
| 3,584,980 | A | 6/1971 | Cawley et al. | |
| 3,586,456 | A | 6/1971 | Giacosa | |
| 3,663,127 | A | 5/1972 | Cheers | |
| 4,065,279 | A | 12/1977 | McCullough | |
| 4,421,453 | A | 12/1983 | Hoff et al. | |
| 4,449,895 | A | 5/1984 | Kurahayashi | |
| 4,456,437 | A | 6/1984 | Kurahayashi et al. | |
| 4,462,772 | A | 7/1984 | Hazaki et al. | |
| 4,551,082 | A | 11/1985 | Hazaki et al. | |
| 4,564,339 | A | 1/1986 | Nakamura et al. | |
| 4,568,253 | A | 2/1986 | Wood | |
| 4,592,703 | A | 6/1986 | Inaba et al. | |
| 4,609,334 | A | 9/1986 | Muir et al. | |
| 4,639,194 | A | 1/1987 | Bell, III et al. | |
| 4,702,682 | A | 10/1987 | Inaba et al. | |
| 4,792,296 | A | 12/1988 | Kobayashi et al. | |
| 5,017,108 | A | 5/1991 | Murayama et al. | |
| 5,176,506 | A | 1/1993 | Siebel | |
| 5,221,191 | A | 6/1993 | Leyderman et al. | |
| 5,322,420 | A | 6/1994 | Yannascoli | |
| 5,368,446 | A | 11/1994 | Rode | |
| 5,385,453 | A | 1/1995 | Fogt et al. | |
| 5,391,066 | A | 2/1995 | Sawai et al. | |
| 5,445,507 | A | 8/1995 | Nakamura et al. | |
| 5,494,422 | A | 2/1996 | Ukai et al. | |
| 5,533,875 | A | 7/1996 | Crum et al. | |
| 5,553,465 | A | 9/1996 | Fukuda et al. | |
| 5,638,600 | A | 6/1997 | Rao et al. | |
| 5,707,220 | A | 1/1998 | Krueger et al. | |
| 5,810,572 | A | 9/1998 | Yamamoto et al. | |
| 5,997,258 | A | 12/1999 | Sawyer, III et al. | |
| 6,039,551 | A | 3/2000 | Takeuchi et al. | |
| 6,196,814 | B1 | 3/2001 | Cooksey et al. | |
| 6,264,446 | B1 | 7/2001 | Rajendran et al. | |
| 7,317,041 | B2 | 1/2008 | Guffogg et al. | |
| 7,381,040 | B2 | 6/2008 | Ogasawara et al. | |
| 7,481,632 | B1 * | 1/2009 | Sun | F04C 29/028 418/94 |
| 7,566,210 | B2 | 7/2009 | Elson et al. | |
| 7,789,616 | B2 | 9/2010 | Yen et al. | |
| 9,217,434 | B2 | 12/2015 | Han et al. | |
| 2004/0219048 | A1 | 11/2004 | Tsuchiya et al. | |
| 2005/0053508 | A1 | 3/2005 | Morozumi et al. | |
| 2005/0069443 | A1 | 3/2005 | Uekawa et al. | |
| 2007/0071627 | A1 | 3/2007 | Lee et al. | |
| 2007/0183917 | A1 | 8/2007 | Um | |
| 2012/0263609 | A1 | 10/2012 | Han et al. | |
| 2014/0219850 | A1 | 8/2014 | Ignatiev et al. | |
| 2015/0044019 | A1 | 2/2015 | Wu et al. | |
| 2015/0361983 | A1 | 12/2015 | Ignatiev et al. | |
| 2016/0201673 | A1 | 7/2016 | Perevozchikov et al. | |
| 2016/0208803 | A1 | 7/2016 | Uekawa et al. | |
| 2016/0222967 | A1 | 8/2016 | Ignatiev et al. | |
| 2017/0002816 | A1 * | 1/2017 | Uekawa | F04C 29/026 |
| 2018/0066656 | A1 | 3/2018 | Perevozchikov et al. | |
| 2018/0223850 | A1 * | 8/2018 | Toyama | F04C 29/0057 |
| 2019/0145414 | A1 * | 5/2019 | Cui | F04C 18/0215 418/55.6 |
| 2020/0362863 | A1 | 11/2020 | Liang et al. | |

FOREIGN PATENT DOCUMENTS

| | | | |
|---|---|---|---|
| CN | 101303018 | A | 11/2008 |
| CN | 202152734 | U | 2/2012 |
| CN | 202300924 | U | 7/2012 |
| CN | 102734170 | A | 10/2012 |
| CN | 103790830 | B | 5/2016 |
| CN | 205578273 | U | 9/2016 |
| CN | 107559203 | A | 1/2018 |
| CN | 206889250 | U | 1/2018 |
| EP | 2700818 | A1 | 2/2014 |
| JP | S58214692 | A | 12/1983 |
| JP | S6220689 | A | 1/1987 |
| JP | H01257787 | A | 10/1989 |
| JP | H0427788 | A | 1/1992 |
| JP | H09177688 | A | 7/1997 |
| JP | H11280668 | A | 10/1999 |
| JP | 2009127614 | A | 6/2009 |
| JP | 2012002227 | A | 1/2012 |
| JP | 2016160774 | A | 9/2016 |
| WO | WO-2013007163 | A1 | 1/2013 |
| WO | WO-2017/190651 | A1 | 11/2017 |
| WO | WO-2020061998 | A1 | 4/2020 |

OTHER PUBLICATIONS

CA Notice of Allowance regarding U.S. Appl. No. 16/829,303 dated Aug. 16, 2021.

Office Action regarding Chinese Patent Application No. 201110089527.2, dated May 5, 2014. Translation provided by Unitalen Attorneys At Law.

Office Action regarding Chinese Patent Application No. 201110089527.2, dated Sep. 24, 2014. Translation provided by Unitalen Attorneys At Law.

Search Report regarding European Patent Application No. 12765121.4, dated Dec. 11, 2014.

Restriction Requirement regarding U.S. Appl. No. 14/355.793, dated Mar. 31. 2017.

Office Action regarding U.S. Appl. No. 14/355,793, dated Sep. 7, 2017.

Office Action regarding U.S. Appl. No. 14/355,793, dated Mar. 19, 2018.

Office Action regarding Indian Patent Application No. 1785/MUMNP/2013, dated May 23, 2018.

Advisory Action regarding U.S. Appl. No. 14/355,793, dated Jun. 12, 2018.

Office Action regarding U.S. Appl. No. 14/355,793, dated Aug. 9, 2018.

International Search Report regarding International Application No. PCT/US2012/031621, dated Oct. 12, 2012.

Written Opinion of the International Searching Authority regarding International Application No. PCT/US2012/031621, dated Oct. 12, 2012.

Applicant-Initiated Interview Summary regarding U.S. Appl. No. 14/355,793, dated Jan. 14, 2019.

Office Action regarding U.S. Appl. No. 14/355,793, dated May 16, 2019.

International Search Report regarding International Application No. PCT/CN2018/108228, dated Jun. 21, 2019.

Written Opinion of the International Searching Authority regarding International Application No. PCT/CN2018/108228, dated Jun. 21, 2019.

Applicant-Initiated Interview Summary regarding U.S. Appl. No. 14/355,793, dated Aug. 6, 2019.

Office Action regarding U.S. Appl. No. 14/355,793, dated Nov. 29, 2019.

Advisory Action regarding U.S. Appl. No. 14/355,793, dated Feb. 20, 2020.

International Search Report and Written Opinion of the ISA regarding Application No. PCT/US2020/024904 dated Jul. 15, 2020.

International Search Report and Written Opinion of the International Searching Authority issued in PCT/CN2018/108228, dated Jun. 21, 2019.

CA Office Action regarding European Patent Application No. 189348709, dated Apr. 26, 2022.

Office Action regarding Chinese Patent Application No. 201880099134X, dated Jul. 19, 2022.

(56) References Cited

OTHER PUBLICATIONS

Translation Office Action regarding Chinese Patent Application No. 201880099134X, dated Jul. 19, 2022.
Studies of Oil Flow Analysis in Hermetic 2013 Aphale et al.
Analysis of Oil Pumping in the Hermetic 2010 Wu et al.
Office Action regarding Chinese Patent Application No. 201880099134X, dated Jan. 20, 2023.

* cited by examiner

COMPRESSOR OIL MANAGEMENT SYSTEM

CROSS-REFERENCE TO RELATED APPLICATIONS

This application is the U.S. National Phase Application under 35 U.S.C. 371 of International Application No. PCT/CN2018/108228 filed on Sep. 28, 2018. The entire disclosure of the application referenced above is incorporated herein by reference.

FIELD

The present disclosure relates to a compressor, and more particularly, to a compressor oil management system.

BACKGROUND

This section provides background information related to the present disclosure and is not necessarily prior art.

A climate-control system such as, for example, a heat-pump system, a refrigeration system, or an air conditioning system, may include a fluid circuit having an outdoor heat exchanger, an indoor heat exchanger, an expansion device disposed between the indoor and outdoor heat exchangers, and one or more compressors circulating a working fluid (e.g., refrigerant or carbon dioxide) between the indoor and outdoor heat exchangers. Efficient and reliable operation of the one or more compressors is desirable to ensure that the climate-control system in which the one or more compressors are installed is capable of effectively and efficiently providing a cooling and/or heating effect on demand. Efficient and effective lubricant distribution throughout the compressor reduces wear and cools internal components of the compressor.

SUMMARY

This section provides a general summary of the disclosure, and is not a comprehensive disclosure of its full scope or all of its features.

The present disclosure provides a compressor that includes a compression mechanism and a driveshaft. The driveshaft drives the compression mechanism. The driveshaft may include a first axially extending passage, a second axially extending passage, and a lubricant distribution passage. The first axially extending passage and the second axially extending passage may be radially offset from each other and may intersect each other at an overlap region. The first and second axially extending passages are in fluid communication with each other at the overlap region. The lubricant distribution passage may extend from the first axially extending passage through an outer diametrical surface of the driveshaft. The lubricant distribution passage may be disposed at a first axial distance from a first axial end of the driveshaft. A first axial end of the overlap region may be disposed at a second axial distance from the first axial end of the driveshaft. The first axial distance may be greater than the second axial distance.

In some configurations of the compressor of the above paragraph, the first axially extending passage is a concentric passage extending through the first axial end of the driveshaft.

In some configurations of the compressor of either of the above paragraphs, a longitudinal axis of the second axially extending passage is radially offset from a rotational axis of the driveshaft.

In some configurations of the compressor of any of the above paragraphs, the second axially extending passage extends through a second axial end of the driveshaft.

In some configurations of the compressor of any of the above paragraphs, the longitudinal axis of the second axially extending passage is parallel to the rotational axis of the driveshaft.

In some configurations of the compressor of any of the above paragraphs, a longitudinal axis of the lubricant distribution passage extends through the overlap region.

In some configurations of the compressor of any of the above paragraphs, the longitudinal axis of the lubricant distribution passage is perpendicular to a rotational axis of the driveshaft.

In some configurations of the compressor of any of the above paragraphs, the compressor includes a shell assembly, a bearing housing assembly, a first pump, and a second pump. The shell assembly may include a partition defining a primary oil sump and a secondary oil sump. The bearing housing assembly may support the driveshaft and extend through a central opening in the partition. The bearing housing assembly may include an oil-transferring passage that provides fluid communication between the secondary and primary oil sumps. The first pump may be attached to the driveshaft and may pump oil from the secondary oil sump to the primary oil sump via the oil-transferring passage. The second pump may be attached to the driveshaft and may pump oil from the primary oil sump into the first axially extending passage in the driveshaft.

In some configurations of the compressor of any of the above paragraphs, the compression mechanism is a scroll-type compression mechanism.

In some configurations of the compressor of any of the above paragraphs, an axial length of the overlap region is at least 1.5 times larger than a diameter of the first axially extending passage.

In some configurations of the compressor of any of the above paragraphs, the lubricant distribution passage is disposed a fourth axial distance from the first axial end of the overlap region. The fourth axial distance may be at least half of the diameter of the first axially extending passage.

In some configurations of the compressor of any of the above paragraphs, the rotational axis of the driveshaft is positioned at an angle of 0-20 degrees relative to horizontal.

The present disclosure provides a compressor that includes a compression mechanism and a driveshaft. The driveshaft drives the compression mechanism. The driveshaft may include a first axially extending passage, a second axially extending passage, and a lubricant distribution passage. The first axially extending passage and the second axially extending passage may be radially offset from each other and may intersect each other at an overlap region. The first and second axially extending passages are in fluid communication with each other at the overlap region. The lubricant distribution passage may extend from the first axially extending passage through an outer diametrical surface of the driveshaft. The lubricant distribution passage may include an inlet disposed at the first axially extending passage and an outlet disposed at the outer diametrical surface of the driveshaft. The inlet of the lubricant distribution passage may be aligned in an axial direction with at least a portion of the overlap region. The axial direction is a direction extending along a rotational axis of the driveshaft.

In some configurations of the compressor of the above paragraph, the first axially extending passage is a concentric passage extending through a first axial end of the driveshaft.

In some configurations of the compressor of either of the above paragraphs, a longitudinal axis of the second axially extending passage is radially offset from the rotational axis of the driveshaft.

In some configurations of the compressor of any of the above paragraphs, the second axially extending passage extends through a second axial end of the driveshaft.

In some configurations of the compressor of any of the above paragraphs, the longitudinal axis of the second axially extending passage is parallel to the rotational axis of the driveshaft.

In some configurations of the compressor of any of the above paragraphs, a longitudinal axis of the lubricant distribution passage extends through the overlap region.

In some configurations of the compressor of any of the above paragraphs, the longitudinal axis of the lubricant distribution passage is perpendicular to a rotational axis of the driveshaft.

In some configurations of the compressor of any of the above paragraphs, the compressor includes a shell assembly, a bearing housing assembly, a first pump, and a second pump. The shell assembly may include a partition defining a primary oil sump and a secondary oil sump. The bearing housing assembly may support the driveshaft and extend through a central opening in the partition. The bearing housing assembly may include an oil-transferring passage that provides fluid communication between the secondary and primary oil sumps. The first pump may be attached to the driveshaft and may pump oil from the secondary oil sump to the primary oil sump via the oil-transferring passage. The second pump may be attached to the driveshaft and may pump oil from the primary oil sump into the first axially extending passage in the driveshaft.

In some configurations of the compressor of any of the above paragraphs, the compression mechanism is a scroll-type compression mechanism.

In some configurations of the compressor of any of the above paragraphs, an axial length of the overlap region is at least 1.5 times larger than a diameter of the first axially extending passage.

In some configurations of the compressor of any of the above paragraphs, the first axially extending passage extends through a first axial end of the driveshaft.

In some configurations of the compressor of any of the above paragraphs, the lubricant distribution passage is disposed an axial distance from the first axial end of the overlap region.

In some configurations of the compressor of any of the above paragraphs, the axial distance is at least half of the diameter of the first axially extending passage.

In some configurations of the compressor of any of the above paragraphs, the rotational axis of the driveshaft is positioned at an angle of 0-20 degrees relative to horizontal.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

Corresponding reference numerals indicate corresponding parts throughout the several views of the drawings.

DETAILED DESCRIPTION

Figure 1:
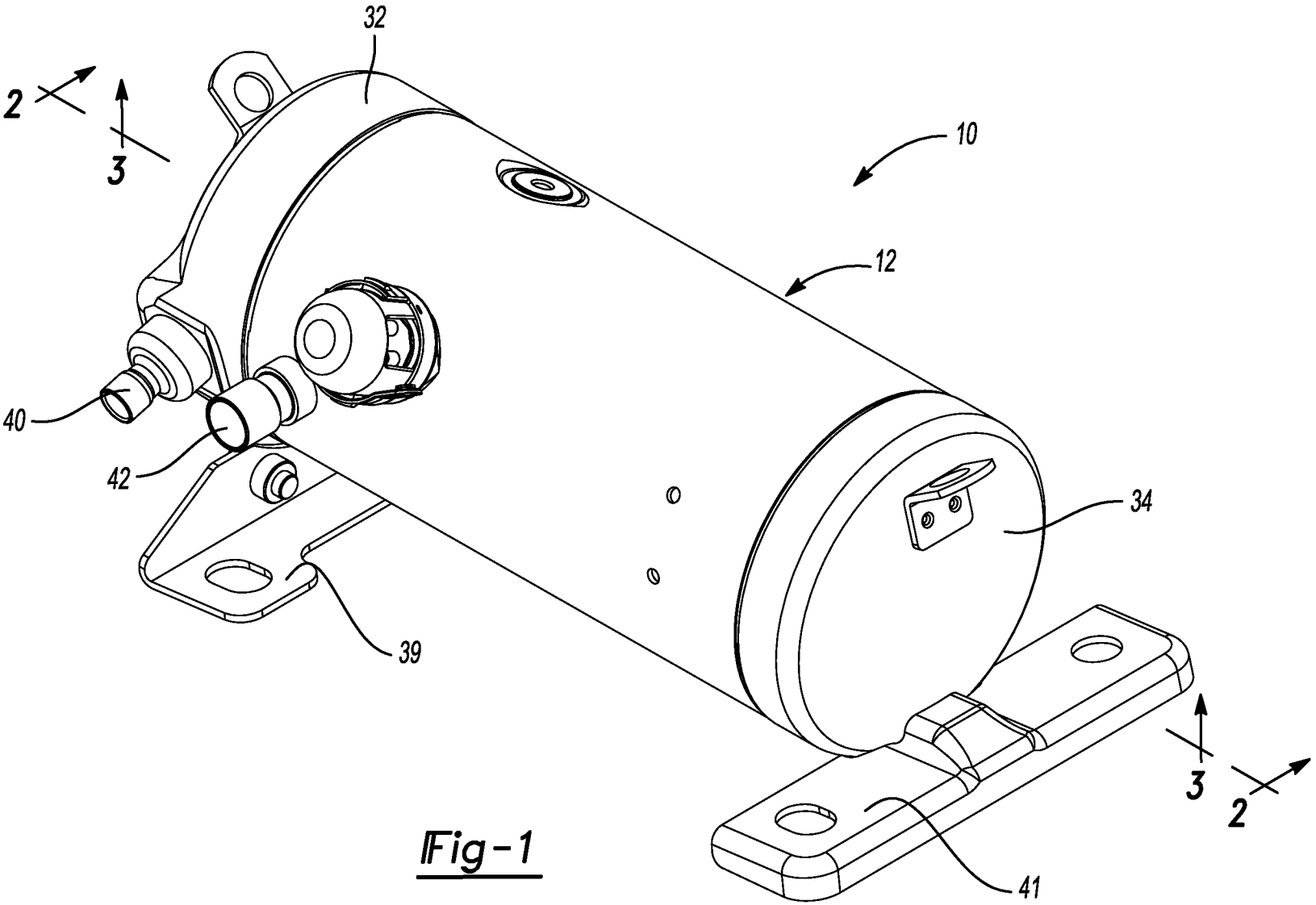
FIG. 1 is a perspective view of a compressor according to the principles of the present disclosure.

Example embodiments will now be described more fully with reference to the accompanying drawings.

Example embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure. In some example embodiments, well-known processes, well-known device structures, and well-known technologies are not described in detail.

The terminology used herein is for the purpose of describing particular example embodiments only and is not intended to be limiting. As used herein, the singular forms "a," "an," and "the" may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

When an element or layer is referred to as being "on," "engaged to," "connected to," or "coupled to" another element or layer, it may be directly on, engaged, connected or coupled to the other element or layer, or intervening elements or layers may be present. In contrast, when an element is referred to as being "directly on," "directly engaged to," "directly connected to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

Spatially relative terms, such as "inner," "outer," "beneath," "below," "lower," "above," "upper," and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

With reference to FIGS. 1-4, a compressor 10 is provided that may include a hermetic shell assembly 12, a first bearing housing assembly 14, a second bearing housing assembly 15, a motor assembly 16, a compression mechanism 18, and a floating seal assembly 20. The shell assembly 12 may house the bearing housing assemblies 14, 15, the motor assembly 16, the compression mechanism 18, and the floating seal assembly 20.

Figure 2:
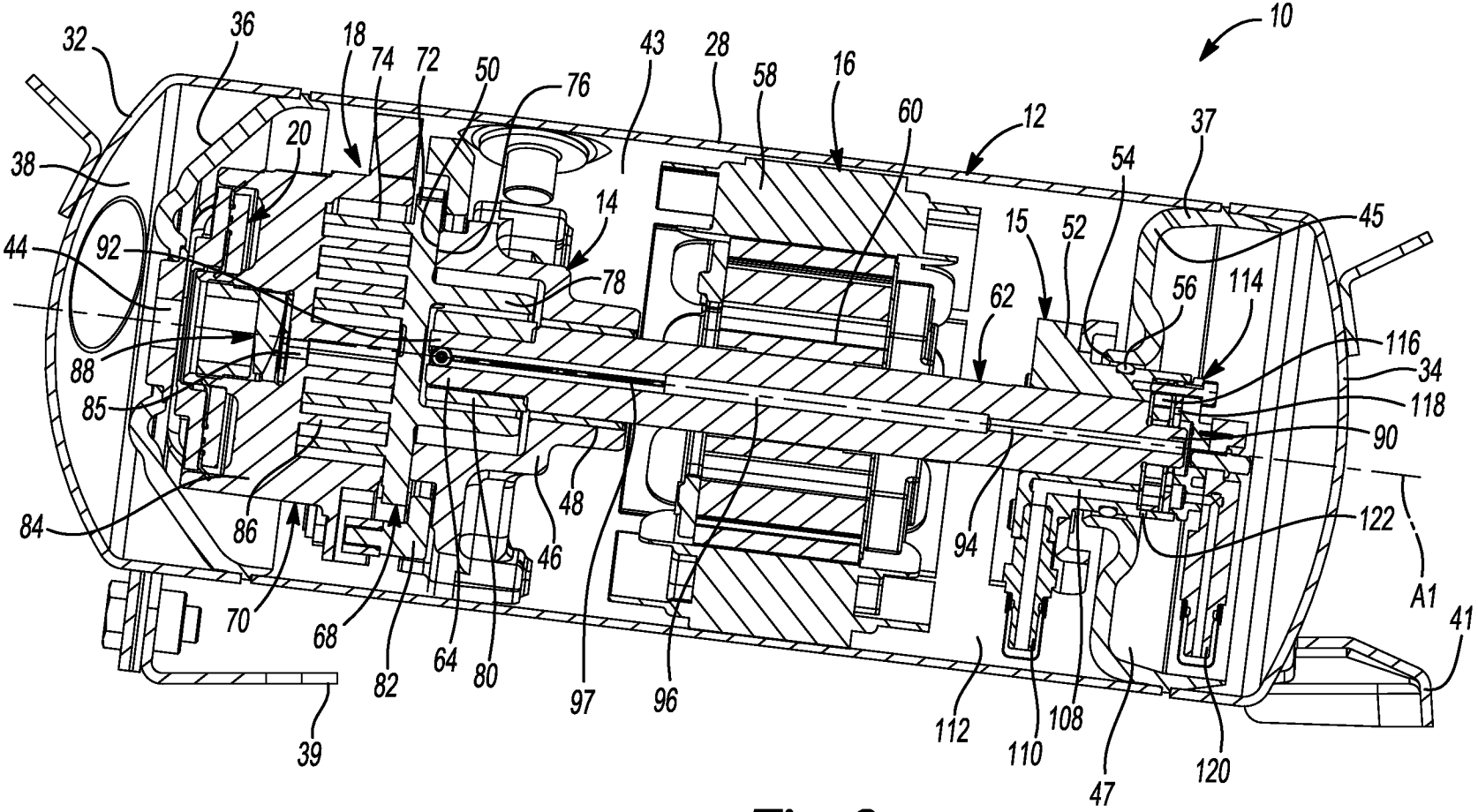
FIG. 2 is a cross-sectional view of the compressor taken at a plane defined by line 2-2 of FIG. 1.

The shell assembly 12 forms a compressor housing and may include a cylindrical shell 28, a first end cap 32 at the one end of the cylindrical shell 28, a second end cap 34 at another end of the cylindrical shell 28, a first transversely extending partition 36, and a second transversely extending partition 37. Mounting brackets or feet 39, 41 may be attached to the first and second end caps 32, 34 and may position the compressor 10 in a tilted configuration (i.e., so that a longitudinal axis of the cylindrical shell 28 is disposed at a non-zero, non-perpendicular angle relative to horizontal and relative to the direction of gravitational pull), as shown in FIG. 2. In this manner, the second end cap 34 is vertically lower than the first end cap 32. For example, the longitudinal axis of the cylindrical shell 28 is at approximately a seven degree angle relative to horizontal (e.g., so that gravity tends to pull oil toward the second end cap 34). The longitudinal axis of the cylindrical shell 28 could be disposed at approximately 0-20 degrees relative to horizontal (i.e., 70-90 degrees relative to the direction of gravitational pull at the location where the compressor 10 is installed).

The first end cap 32 and the first partition 36 may generally define a discharge chamber 38. The discharge chamber 38 may generally form a discharge muffler for compressor 10. While the compressor 10 is illustrated as including the discharge chamber 38, the present disclosure applies equally to direct discharge configurations. A discharge fitting 40 (FIG. 1) may be attached to the shell assembly 12 at an opening in the first end cap 32. A suction gas inlet fitting 42 (FIGS. 1 and 3) may be attached to the shell assembly 12 at another opening. The suction gas inlet fitting 42 may be open to and in fluid communication with a suction chamber 43 defined by the cylindrical shell 28, the first partition, and the second end cap 34. The first partition 36 and the floating seal assembly 20 cooperate to separate the discharge chamber 38 from the suction chamber 43. Suction-pressure working fluid within the suction chamber 43 may be drawn into the compression mechanism 18 during operation of the compressor 10. The first partition 36 may include a discharge passage 44 therethrough providing communication between the compression mechanism 18 and the discharge chamber 38.

The second partition 37 and the second end cap 34 may cooperate to define an oil sump 47 (e.g., a primary oil sump). The oil sump 47 may contain a volume of lubricant that may be pumped throughout the compressor 10, as will be described in more detail below. The second partition 37 may include one or more vent openings 45 (FIG. 2) to vent the space between the second partition 37 and the second end cap 34 to the suction chamber 43.

The first bearing housing assembly 14 may be affixed to the shell 28 and may include a first bearing housing 46 and a first bearing 48 disposed therein. The first bearing housing 46 may house the bearing 48 therein and may define an annular flat thrust bearing surface 50 on an axial end surface thereof. The second bearing housing assembly 15 may be affixed to the shell 28 and may include a second bearing housing 52 and a second bearing (not shown) disposed therein. The second bearing housing 52 may extend through a central opening 54 in the second partition 37 (i.e., so that the second partition 37 surrounds a portion of the second bearing housing 52. An annular seal 56 may sealingly engage the second partition 37 and the second bearing housing 52.

The motor assembly 16 may be a variable-speed motor. The motor assembly 16 may include a motor stator 58, a rotor 60, and a driveshaft 62. The motor stator 58 may be press fit into the shell 28. The driveshaft 62 may be rotatably driven by the rotor 60 and may be rotatably supported by the bearing housing assemblies 14, 15. The rotor 60 may be press fit on the driveshaft 62. The driveshaft 62 may include an eccentric crankpin 64.

As described above, the cylindrical shell 28 is positioned in a horizontal or titled horizontal configuration. Therefore, a rotational axis A1 of the driveshaft 62 may be at approximately a seven degree angle relative to horizontal (e.g., so that gravity tends to pull oil toward the second end cap 34). The rotational axis A1 of the driveshaft 62 could be disposed at approximately 0-20 degrees relative to horizontal (i.e., 70-90 degrees relative to the direction of gravitational pull at the location where the compressor 10 is installed).

The compression mechanism 18 may include a first scroll (e.g., an orbiting scroll 68) and a second scroll (e.g., a non-orbiting scroll 70). The orbiting scroll 68 may include an end plate 72 having a spiral wrap 74 on the upper surface thereof and an annular flat thrust surface 76 on the lower surface. The thrust surface 76 may interface with the annular flat thrust bearing surface 50 on the first bearing housing 46. A cylindrical hub 78 may project downwardly from the thrust surface 76 and may have a drive bushing 80 rotatably disposed therein. The drive bushing 80 may include an inner bore in which the crank pin 64 is drivingly disposed. A flat surface of the crankpin 64 may drivingly engage a flat surface in a portion of the inner bore of the drive bushing 80 to provide a radially compliant driving arrangement. An Oldham coupling 82 may be engaged with the orbiting scroll 68 and either the non-orbiting scroll 70 or the first bearing housing 46 to prevent relative rotation between the scrolls 68, 70.

The non-orbiting scroll 70 may include an end plate 84 defining a discharge passage 85 and having a spiral wrap 86 extending from a first side thereof. The non-orbiting scroll 70 may be attached to the first bearing housing 46 via fasteners and sleeve guides that allow for a limited amount of axial movement of the non-orbiting scroll 70 relative to the orbiting scroll 68 and the first bearing housing 46. The spiral wraps 74, 86 may be meshingly engaged with one another and define compression pockets therebetween. A discharge valve assembly 88 may be disposed within or adjacent the discharge passage 85 to restrict or prevent fluid flow from the discharge chamber 38 back into the compression mechanism 18.

Figure 3:
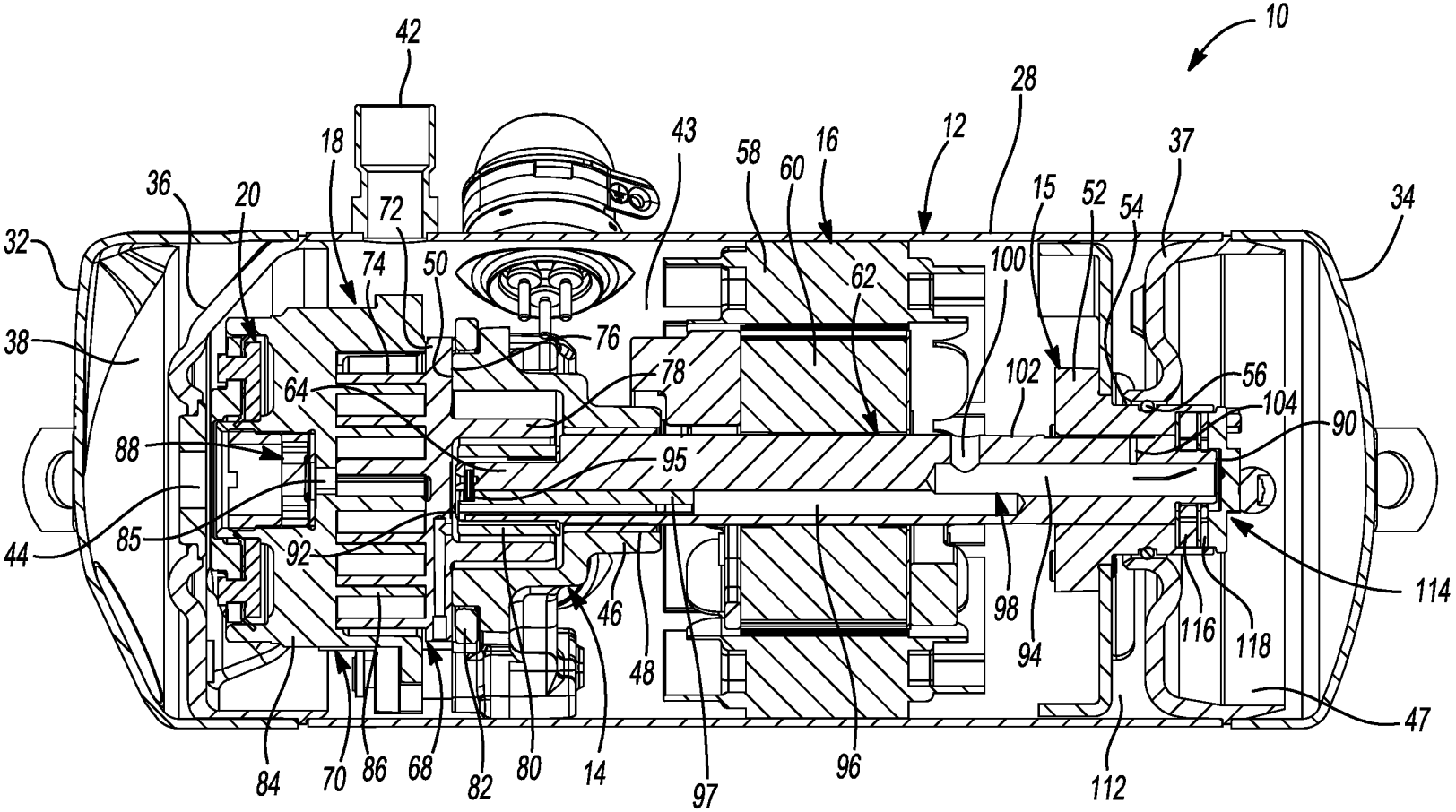
FIG. 3 is a cross-sectional view of the compressor taken at a plane defined by line 3-3 of FIG. 1.
Figure 4:
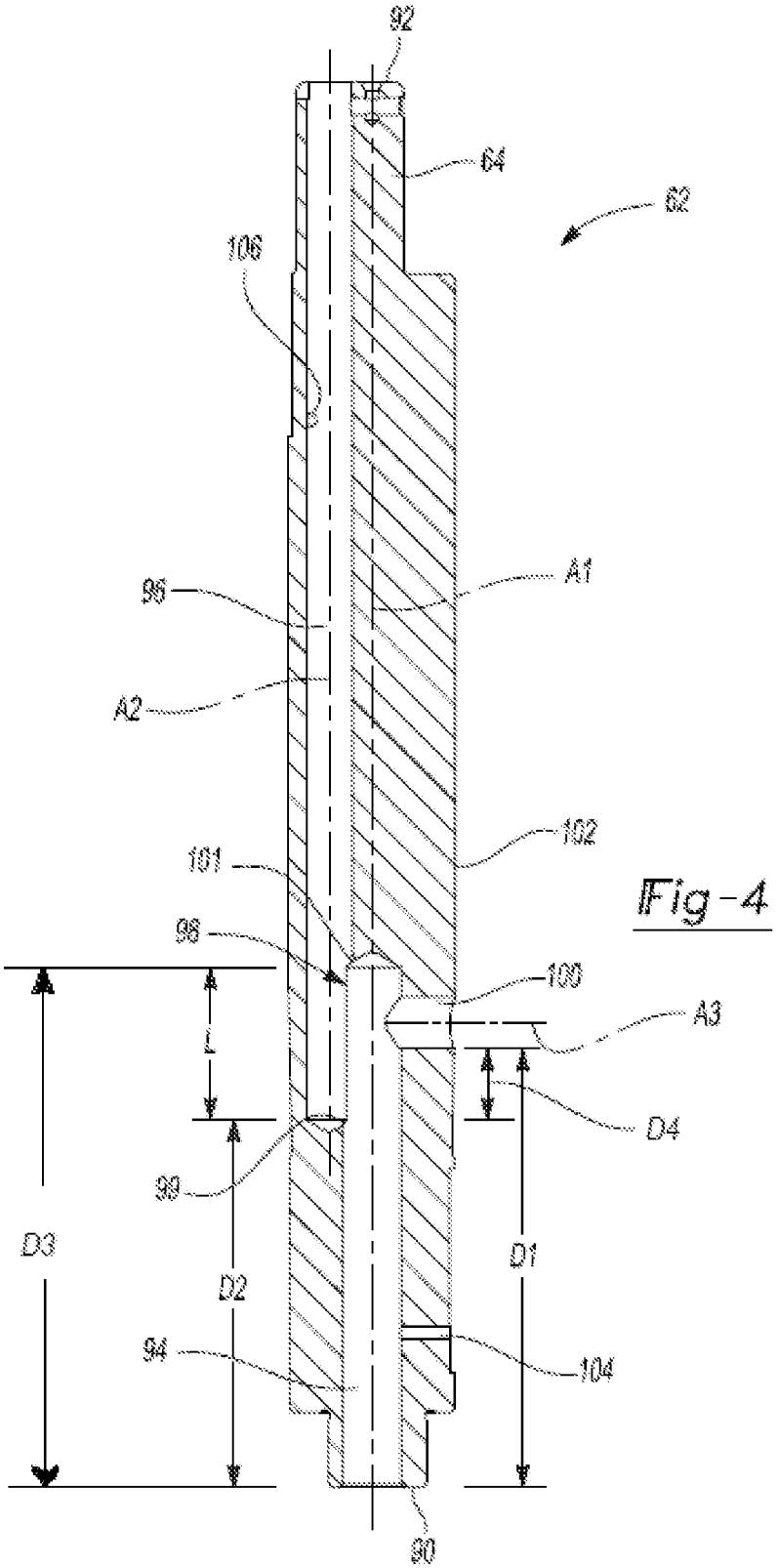
FIG. 4 is a cross-sectional view of a driveshaft of the compressor.

Referring now to FIGS. 2-4, the driveshaft 62 includes a first axial end 90 and a second axial end 92. The crankpin 64 is disposed at the second axial end 92. The driveshaft 62 may include a first axially extending passage 94 (i.e., a first passage that extends along or parallel to the rotational axis A1 (FIG. 4) of the driveshaft 62) and a second axially extending passage 96 (i.e., a second passage that extends parallel to or generally alongside the rotational axis A1 of the driveshaft 62). The first axially extending passage 94 may be a concentric passage (e.g., a longitudinal axis of the first axially extending passage 94 may be collinear or approximately collinear with the rotational axis A1 of the driveshaft 62). The second axially extending passage 96 may be an eccentric passage (e.g., a longitudinal axis A2 of the second axially extending passage 96 is radially offset from the rotational axis A1 of the driveshaft 62). In some configurations, the longitudinal axis A2 of the second axially extending passage 96 is parallel to the rotational axis A1 of the driveshaft 62. In other configurations, the longitudinal axis A2 of the second axially extending passage 96 may be angled relative to the rotational axis A1 of the driveshaft.

In some configurations, an oil allocation insert 97 (FIGS. 2 and 3) may be received within the second axially extending passage 96. For example, a retention pin 95 and/or a fastener may fixedly retain the oil allocation insert 97 within the second axially extending passage 96. The oil allocation insert 97 can be sized to partially restrict the flow of oil through the second axially extending passage 96 to achieve desired flow rates through the second axially extending passage 96. In other configurations, the driveshaft 62 does not include the oil allocation insert 97.

The first axially extending passage 94 may extend through the first axial end 90 of the driveshaft 62 and may extend through only a portion of the length of the driveshaft 62. The second axially extending passage 96 may extend through the second axial end 92 of the driveshaft 62 and may extend through only another portion of the length of the driveshaft 62. The first and second axially extending passages 94, 96 overlap each other at an overlap region 98. The overlap region 98 includes a portion of the length of the first axially extending passage 94 and a portion of the length of the second axially extending passage 96 that intersect each other and are open to each other to fluidly communicate with each other. In other words, the overlap region 98 is an opening through which fluid can flow from the first axially extending passage 94 to the second axially extending passage 96 (and from the second axially extending passage 96 to the first axially extending passage 94).

The driveshaft 62 may also include a lubricant distribution passage 100 (FIGS. 3 and 4). The lubricant distribution passage 100 may extend radially outward from the first axially extending passage 94 and through an outer diametrical surface 102 of the driveshaft 62. As shown in FIG. 4, a longitudinal axis A3 of the lubricant distribution passage 100 may be perpendicular to the rotational axis A1 of the driveshaft 62. The longitudinal axis A3 of the lubricant distribution passage 100 may extend through the overlap region 98. As shown in FIG. 4, the lubricant distribution passage 100 is positioned such that a first axial distance D1 (i.e., a distance along the rotational axis A1) between the lubricant distribution passage 100 and the first axial end 90 of the driveshaft 62 is greater than a second axial distance D2 (i.e., a distance along the rotational axis A1) between a first axial end 99 of the overlap region 98 and the first axial end 90 of the driveshaft 62. As shown in FIG. 3, the lubricant distribution passage 100 may be disposed between the second bearing housing 52 and the rotor 60 such that a flow of lubricant through the lubricant distribution passage 100 is not restricted by the second bearing housing 52 or the rotor 60.

In some configurations, the entire lubricant distribution passage 100 is axially closer (closer in a direction along or parallel to the rotational axis A1) to the first axial end 90 of the driveshaft 62. In other words, an axial distance between the first axial end 90 of the driveshaft 62 and a second axial end 101 of the overlap region 98 is greater than the sum of the first axial distance D1 plus the diameter of the lubricant distribution passage 100.

The driveshaft 62 may also include a first radially extending passage 104 and a second radially extending passage 106. The first radially extending passage 104 may extend from the first axially extending passage 94 through the outer diametrical surface 102 of the driveshaft 62. The first radially extending passage 104 may be disposed an axial distance (i.e., a distance along the rotational axis A1) from the first axial end 90 that is less than the second axial distance D2. As shown in FIG. 3, the first radially extending passage 104 may be positioned to allow a portion of the lubricant in the first axially extending passage 94 to flow radially outward to the second bearing housing assembly 15 to lubricate the bearing of the second bearing housing assembly 15.

The second radially extending passage 106 may extend from the second axially extending passage 96 through the outer diametrical surface 102 of the driveshaft 62. The second radially extending passage 106 may be disposed an axial distance (i.e., a distance along the rotational axis A1) from the second axial end 92 that is less than an axial distance between the second axial end 92 and the overlap region 98. The second radially extending passage 106 may be positioned to allow a portion of the lubricant in the second axially extending passage 96 to flow radially outward to the first bearing housing assembly 14 to lubricate the bearing 48 of the first bearing housing assembly 14.

Referring now to FIG. 2, the second bearing housing 52 may include an oil-transferring passage 108. A first oil pickup fitting 110 may be attached to the second bearing housing 52 and may extend vertically downward (radially outward relative to the rotational axis A1) from the second bearing housing 52. The first oil pickup fitting 110 may extend down into an oil collection area 112 (i.e., a secondary oil sump) that may be defined by the cylindrical shell 28 and the second partition 37. The first oil pickup fitting 110 provides fluid communication between the oil collection area 112 and the oil-transferring passage 108.

As shown in FIG. 2, a pump assembly 114 may be mounted to second bearing housing 52 between the second partition 37 and the second end cap 34. The pump assembly 114 may include a first pump 116, a second pump 118, and a second oil pickup fitting 120. The first and second pumps 116, 118 may each include a rotor (or impeller) disposed within a pump housing. The rotors of the first and second pumps 116, 118 may be attached to the driveshaft 62 for rotational with the driveshaft 62.

During rotation of the driveshaft 62, the first pump 116 may draw oil from the oil collection area 112 into the first oil pickup fitting 110 and through the oil-transferring passage 108 and discharge the oil into the oil sump 47 via an outlet 122 in the second bearing housing 52. In this manner, during rotation of the driveshaft 62, the first pump 116 transfers oil from the oil collection area 112 to the oil sump 47.

Furthermore, during rotation of the driveshaft 62, the second pump 118 may draw oil from the oil sump 47 through the second oil pickup fitting 120 and force the oil into the first axially extending passage 94 in the driveshaft 62. Some of the oil in the first axially extending passage 94 oil may flow through first radially extending passage 104 (FIGS. 3 and 4) to lubricate the bearing in the second bearing housing assembly 15; some of the oil in the first axially extending passage 94 may flow through the lubricant distribution passage 100 and back to the oil collection area 112; and some of the oil in the first axially extending passage 94 may flow into the second axially extending passage 96. Some of the oil in the second axially extending passage 96 may flow through the second radially extending passage 106 (FIG. 4) to lubricate the bearing 48 in the first bearing housing assembly 14; and some of the oil in the second axially extending passage 96 may flow all of the way through the second axially extending passage 96 (i.e., to the second axial end 92 of the driveshaft 62) and flow into the hub 78 of the orbiting scroll 68 to lubricate the compression mechanism 18.

As shown in FIG. 4, the overlap region 98 has an axial length L (i.e., an axial distance between the first axial end 99 of the overlap region 98 and the second axial end 101 of the overlap region 98). In some configurations, the axial length L of the overlap region 98 is 1.5 times (or more) larger than a diameter of the first axially extending passage 94. The second axial end 101 of the overlap region 98 is disposed a third axial distance D3 from the first axial end 99 of the driveshaft 62. The lubricant distribution passage 100 is disposed a fourth axial distance D4 (i.e., a difference between the first axial distance D1 and the second axial distance D2) from the first axial end 99 of the overlap region. In some configurations, the fourth axial distance D4 may be half (or more) of the diameter of the first axially extending passage 94. In some configurations, the fourth axial distance D4 may be approximately equal to the diameter of the first axially extending passage 94. In some configurations, the diameter of the lubricant distribution passage 100 may be half (or more) of the diameter of the first axially extending passage 94. In some configurations, the diameter of the lubricant distribution passage 100 may be about 0.8-1 times the diameter of the first axially extending passage 94. In some configurations, the driveshaft 62 could include multiple relatively smaller lubricant distribution passages 100 instead of a single relatively larger lubricant distribution passage 100.

The magnitudes of the axial length L, the fourth axial distance D4, and the diameter of the lubricant distribution passage 100 determine how much oil from the first axially extending passage 94 will flow into the second axially extending passage 96 and how much oil from the first axially extending passage 94 will flow through the lubricant distribution passage 100.

Positioning the lubricant distribution passage 100 along the axial length L at the fourth axial distance D4 improves oil management over the range of the compressor's motor speeds and maintains a relatively constant oil level (or at least an adequate oil level) in the oil sump 47 at all motor speeds. That is, by directing some of the oil from the first axially extending passage 94 through the lubricant distribution passage 100 instead of through the second axially extending passage 96, an appropriate amount of oil can be returned directly back to the oil collection area 112 (rather than building up above the stator 58 or travelling into the compression mechanism 18, becoming entrained in working fluid (refrigerant) and being discharged from the compressor) and then pumped (via the first pump 116) back into the oil sump 47.

While the compression mechanism 18 is described above as being a scroll-type compression mechanism, the principles of the present disclosure are applicable to other types of compression mechanisms. Therefore, in some configurations, the compression mechanism of the compressor 10 could be a reciprocating-type compression mechanism (e.g., including one or more pistons that reciprocate within one or more cylinders), a rotary-vane-type compression mechanism (e.g., including a rotor that rotates within a cylinder and a vane that reciprocates relative to the rotor and cylinder), or a rotary-screw-type compressor (e.g., having meshing helical screws), for example.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

What is claimed is:

1. A compressor comprising:

a compression mechanism;

a driveshaft driving the compression mechanism, wherein the driveshaft includes a first axial end and a second axial end, wherein the driveshaft includes an eccentric crankpin defining the second axial end, and wherein the driveshaft includes a first axially extending passage, a second axially extending passage, and a lubricant distribution passage;

a first bearing housing supporting the driveshaft;

a second bearing housing supporting the driveshaft; and a motor assembly disposed between the first bearing housing and the second bearing housing, wherein:

the first axially extending passage extends through the first axial end of the driveshaft, the second axially extending passage extends through the second axial end of the driveshaft, the first axially extending passage and the second axially extending passage are radially offset from each other and intersect each other at an overlap region, the first and second axially extending passages are in fluid communication with each other at the overlap region, the lubricant distribution passage extends from the first axially extending passage through an outer diametrical surface of the driveshaft, the lubricant distribution passage is disposed at a first axial distance from the first axial end of the driveshaft, a first axial end of the overlap region is disposed at a second axial distance from the first axial end of the driveshaft, a second axial end of the overlap region is disposed a third axial distance from the first axial end of the driveshaft, the first axial distance is greater than the second axial distance and less than the third axial distance, an inlet of the lubricant distribution passage and an outlet of the lubrication passage are axially closer to the first axial end of the driveshaft than third axial distance and axially further from the first axial end of the driveshaft second axial distance, and an outlet of the lubricant distribution passage provides lubricant directly to a portion of the motor assembly.

2. The compressor of claim 1, wherein a rotational axis of the driveshaft extends along and through the first axially extending passage.

3. The compressor of claim 2, wherein a longitudinal axis of the second axially extending passage is radially offset from the rotational axis of the driveshaft.

4. The compressor of claim 3, wherein the longitudinal axis of the second axially extending passage is parallel to the rotational axis of the driveshaft.

5. The compressor of claim 3, wherein a longitudinal axis of the lubricant distribution passage extends through the overlap region.

6. The compressor of claim 5, wherein the longitudinal axis of the lubricant distribution passage is perpendicular to the rotational axis of the driveshaft.

7. The compressor of claim 1, further comprising:

a shell assembly including a partition defining a primary oil sump and a secondary oil sump, wherein the second bearing housing extends through a central opening in the partition, and wherein the second bearing housing includes an oil-transferring passage that provides fluid communication between the secondary and primary oil sumps;

a first pump attached to the driveshaft and pumping oil from the secondary oil sump to the primary oil sump via the oil-transferring passage; and a second pump attached to the driveshaft and pumping oil from the primary oil sump into the first axially extending passage in the driveshaft.

8. The compressor of claim 1, wherein the compression mechanism is a scroll-type compression mechanism.

9. A compressor comprising:

a compression mechanism; and a driveshaft driving the compression mechanism, wherein the driveshaft includes a first axial end and a second axial end, wherein the driveshaft includes an eccentric crankpin defining the second axial end, and wherein the driveshaft includes a first axially extending passage, a second axially extending passage, and a lubricant distribution passage, wherein:

the first axially extending passage extends through the first axial end of the driveshaft, the second axially extending passage extends through the second axial end of the driveshaft, the first axially extending passage and the second axially extending passge are radially offset from each other and intersect each other at an overlap region, the first and second axially extending passages are in fluid communication with each other at the overlap region, the lubricant distribution passage extends from the first axially extending passage through an outer diametrical surface of the driveshaft, the lubricant distribution passage is disposed at a first axial distance from the first axial end of the driveshaft, a first axial end of the overlap region is disposed at a second axial distance from the first axial end of the driveshaft, a second axial end of the overlap region is disposed a third axial distance from the first axial end of the driveshaft, the first axial distance is greater than the second axial distance and less than the third axial distance, and an axial length of the overlap region is at least 1.5 times larger than a diameter of the first axially extending passage.

10. The compressor of claim 9, wherein the lubricant distribution passage is disposed a fourth axial distance from the first axial end of the overlap region, and wherein the fourth axial distance is at least half of the diameter of the first axially extending passage, wherein the compressor includes a first bearing housing supporting the driveshaft and a second bearing housing supporting the driveshaft, and wherein an inlet of the lubricant distribution passage and an outlet of the lubricant distribution passage are axially closer to the first axial end of the driveshaft than the third axial distance and axially further from the first axial end of the driveshaft than the second axial distance, and the outlet of the lubricant distribution passage is disposed axially between the first bearing housing and the second bearing housing.

11. A compressor comprising:

a compression mechanism; and a driveshaft driving the compression mechanism, wherein the driveshaft includes a first axial end and a second axial end, wherein the driveshaft includes an eccentric crankpin defining the second axial end, and wherein the driveshaft includes a first axially extending passage, a second axially extending passage, and a lubricant distribution passage;

a first bearing housing supporting the driveshaft;

a second bearing housing supporting the driveshaft; and a motor assembly disposed between the first bearing housing and the second bearing housing, wherein:

the first axially extending passage extends through the first axial end of the driveshaft, the second axially extending passage extends through the second axial end of the driveshaft, the first axially extending passage and the second axially extending passage are radially offset from each other and intersect each other at an overlap region, the lubricant distribution passage includes an inlet disposed at the first axially extending passage and an outlet disposed at an outer diametrical surface of the driveshaft, the inlet of the lubricant distribution passage is aligned in an axial direction with at least a portion of the overlap region, the axial direction is a direction extending along a rotational axis of the driveshaft, and the outlet of the lubricant distribution passage provides lubricant directly to a portion of the motor assembly.

12. The compressor of claim 11, wherein the rotational axis of the driveshaft extends along and through the first axially extending passage.

13. The compressor of claim 12, wherein a longitudinal axis of the second axially extending passage is radially offset from the rotational axis of the driveshaft.

14. The compressor of claim 13, wherein the longitudinal axis of the second axially extending passage is parallel to the rotational axis of the driveshaft.

15. The compressor of claim 13, wherein a longitudinal axis of the lubricant distribution passage extends through the overlap region.

16. The compressor of claim 15, wherein the longitudinal axis of the lubricant distribution passage is perpendicular to a rotational axis of the driveshaft.

17. The compressor of claim 11, further comprising:

a shell assembly including a partition defining a primary oil sump and a secondary oil sump, wherein the second bearing housing extends through a central opening in the partition, and wherein the second bearing housing includes an oil-transferring passage that provides fluid communication between the secondary and primary oil sumps;

a first pump attached to the driveshaft and pumping oil from the secondary oil sump to the primary oil sump via the oil-transferring passage; and a second pump attached to the driveshaft and pumping oil from the primary oil sump into the first axially extending passage in the driveshaft.

18. The compressor of claim 11, wherein the compression mechanism is a scroll-type compression mechanism.

19. The compressor of claim 11, wherein the rotational axis of the driveshaft is positioned at an angle of 0-20 degrees relative to horizontal.

20. A compressor comprising:

a compression mechanism; and a driveshaft driving the compression mechanism, wherein the driveshaft includes a first axial end and a second axial end, wherein the driveshaft includes an eccentric crankpin defining the second axial end, and wherein the driveshaft includes a first axially extending passage, a second axially extending passage, and a lubricant distribution passage, wherein:

the first axially extending passage extends through the first axial end of the driveshaft, the second axially extending passage extends through the second axial end of the driveshaft, the first axially extending passage and the second axially extending passge are radially offset from each other and intersect each other at an overlap region, the lubricant distribution passage includes an inlet disposed at the first axially extending passage and an outlet disposed at an outer diametrical surface of the driveshaft, the inlet of the lubricant distribution passage is aligned in an axial direction with at least a portion of the overlap region, the axial direction is a direction extending along a rotational axis of the driveshaft, and an axial length of the overlap region is at least 1.5 times larger than a diameter of the first axially extending passage.

21. The compressor of claim 20, wherein the lubricant distribution passage is disposed an axial distance from the first axial end of the overlap region, and wherein the axial distance is at least half of the diameter of the first axially extending passage.

* * * * *